US010214800B2

(12) United States Patent
Paton et al.

(10) Patent No.: US 10,214,800 B2
(45) Date of Patent: Feb. 26, 2019

(54) HIGH DURABILITY STRUCTURES OF AMORPHOUS ALLOY AND A METHOD OF FORMING

(75) Inventors: Neil Paton, Thousand Oaks, CA (US); William L. Johnson, Pasadena, CA (US); Tranquoc Nguyen, Anaheim, CA (US)

(73) Assignee: Crucible Intellectual Property, LLC, Rancho Santa Margarita, CA (US)

( * ) Notice: Subject to any disclaimer, the term of this patent is extended or adjusted under 35 U.S.C. 154(b) by 1035 days.

(21) Appl. No.: 10/565,839

(22) PCT Filed: Aug. 13, 2004

(86) PCT No.: PCT/US2004/026367

§ 371 (c)(1),
(2), (4) Date: Mar. 19, 2007

(87) PCT Pub. No.: WO2005/017219

PCT Pub. Date: Feb. 24, 2005

(65) Prior Publication Data

US 2007/0226979 A1 Oct. 4, 2007

Related U.S. Application Data

(60) Provisional application No. 60/495,242, filed on Aug. 13, 2003.

(51) Int. Cl.

| | |
|---|---|
| ***C22C 45/10*** | (2006.01) |
| ***C22C 45/00*** | (2006.01) |
| ***C22F 1/00*** | (2006.01) |

(52) U.S. Cl.

CPC ..... *C22C 45/10* (2013.01); *C22C 45/00* (2013.01); *C22F 1/00* (2013.01); *Y10T 29/479* (2015.01)

(58) Field of Classification Search

CPC ... A63B 53/04; A63B 53/0466; A63B 53/047; A63B 2053/0416; A63B 2053/0445; A63B 2209/00; C21D 7/06; Y10T 29/47; Y10T 29/479; B24C 1/10

USPC ..... 29/90.01, 90.7; 72/53; 148/403

See application file for complete search history.

(56) References Cited

U.S. PATENT DOCUMENTS 2,954,231 A * 9/1960 MacIntyre ..... A63B 53/0487 473/251
4,699,383 A * 10/1987 Kobayashi ..... 473/348
5,090,702 A * 2/1992 Viste ..... A63B 53/04 473/331
5,208,090 A * 5/1993 Okitsu et al. ..... 428/113
5,226,652 A * 7/1993 Sato ..... 473/312
5,232,361 A * 8/1993 Sachdeva et al. ..... 433/8
5,288,344 A * 2/1994 Peker et al. ..... 148/403
5,487,543 A * 1/1996 Funk ..... A63B 53/04 473/332
5,611,742 A * 3/1997 Kobayashi ..... A63B 53/04 473/331
5,676,605 A * 10/1997 Kobayashi ..... A63B 53/04 473/331
5,735,755 A * 4/1998 Kobayashi ..... A63B 53/04 473/331
5,863,360 A * 1/1999 Wood et al. ..... 148/561
5,896,642 A * 4/1999 Peker et al. ..... 29/522.1
6,089,992 A * 7/2000 Onuki ..... A63B 53/04 473/324
6,203,449 B1 * 3/2001 Kenmi ..... A63B 53/0466 473/346
6,273,831 B1 * 8/2001 Dewanjee ..... A63B 53/04 273/DIG. 8
6,299,548 B1 * 10/2001 Lin ..... A63B 53/04 473/331
6,322,459 B1 * 11/2001 Nishimura ..... A63B 53/04 473/330
6,390,932 B1 * 5/2002 Kosmatka ..... A63B 53/04 473/324
6,471,604 B2 * 10/2002 Hocknell et al. ..... 473/334
6,623,376 B2 * 9/2003 Poynor ..... A63B 53/0466 148/516
6,638,577 B2 * 10/2003 Sano et al. ..... 427/475
6,685,577 B1 * 2/2004 Scruggs ..... A63B 53/00 473/345
6,759,261 B2 7/2004 Shimokohbe et al.
6,913,702 B2 * 7/2005 Kurachi et al. ..... 216/11
6,994,635 B2 * 2/2006 Poynor ..... 473/324

(Continued)

FOREIGN PATENT DOCUMENTS

EP 0710493 A1 * 5/1996 ..... A63B 53/04
GB 2233566 A * 1/1991 ..... A63B 53/00

(Continued)

OTHER PUBLICATIONS

Abstract of JP 2001-262291 A.*
English machine translation of JP 2000-288135 A.*
English machine translation of JP 2001-262291 A.*
English machine translation of JP 2004-292923 A.*

(Continued)

*Primary Examiner* — Sarang Afzali

(74) *Attorney, Agent, or Firm* — Brownstein Hyatt Farber Schreck, LLP

(57) ABSTRACT

Articles of bulk-solidifying amorphous alloys such as a golf club face insert with improved durability and fatigue resistance, and more specifically articles of bulk-solidifying amorphous alloys subjected to a surface treatment, such as shot-peening, which creates deformations in the exterior surface, and methods of improving the durability and fatigue resistance of bulk-solidifying amorphous alloys using a surface treatment, such as shot-peening.

10 Claims, No Drawings

(56) References Cited

U.S. PATENT DOCUMENTS

| | | | | |
|---|---|---|---|---|
| 7,258,625 | B2 * | 8/2007 | Kawaguchi | A63B 53/0466 473/329 |
| 7,357,731 | B2 * | 4/2008 | Johnson et al. | 473/349 |
| 7,727,407 | B2 * | 6/2010 | Kurachi et al. | 216/11 |
| 7,794,335 | B2 * | 9/2010 | Cole | A63B 53/04 473/342 |
| 2002/0136842 | A1 * | 9/2002 | Sano et al. | 427/475 |
| 2002/0193177 | A1 * | 12/2002 | Poynor | 473/345 |
| 2003/0222122 | A1 * | 12/2003 | Johnson et al. | 228/101 |
| 2004/0058742 | A1 * | 3/2004 | Poynor | 473/324 |
| 2005/0009623 | A1 * | 1/2005 | Dickinson | A63B 53/04 473/329 |
| 2005/0124433 | A1 * | 6/2005 | Scruggs et al. | 473/316 |
| 2005/0211673 | A1 * | 9/2005 | Kurachi et al. | 216/83 |
| 2006/0065333 | A1 * | 3/2006 | Hackel et al. | 148/565 |
| 2006/0149391 | A1 * | 7/2006 | Opie et al. | 623/23.55 |
| 2006/0154745 | A1 * | 7/2006 | Johnson et al. | 473/345 |
| 2012/0152412 | A1 * | 6/2012 | Opie et al. | 148/537 |
| 2012/0158151 | A1 * | 6/2012 | Opie et al. | 623/18.11 |
| 2012/0160374 | A1 * | 6/2012 | Li et al. | 148/403 |

FOREIGN PATENT DOCUMENTS

| | | | | |
|---|---|---|---|---|
| JP | 2000288135 | A * | 10/2000 | A63B 53/04 |
| JP | 2001170867 | A * | 6/2001 | A63B 53/04 |
| JP | 2002180217 | A * | 6/2002 | |
| JP | 2003211357 | A * | 7/2003 | B24C 1/10 |
| JP | 2004292923 | A * | 10/2004 | C22F 1/00 |
| WO | WO 9720601 | A1 * | 6/1997 | A63B 53/00 |
| WO | WO 02/022906 | | 3/2003 | |
| WO | WO 2007146398 | A2 * | 12/2007 | A63B 53/04 |

OTHER PUBLICATIONS

English Machine Translation of JP2000288135(A), Oct. 17, 2000.*
International Search Report dated Dec. 27, 20014, PCT/US2004/026367, 2 pages.

* cited by examiner

HIGH DURABILITY STRUCTURES OF AMORPHOUS ALLOY AND A METHOD OF FORMING

CROSS-REFERENCE TO RELATED APPLICATIONS

This application is a 35 U.S.C. § 371 application of PCT/US2004/026367, filed on Aug. 13, 2004, and entitled "High Durability Structures of Amorphous Alloy and a Method of Forming," which claims the benefit under 35 U.S.C. § 119(e) of U.S. Provisional Patent Application No. 60/495,242, filed on Aug. 13, 2003, and entitled "High Durability Structures of Amorphous Alloy and a Method of Forming," the contents of which are incorporated by reference as if fully disclosed herein.

FIELD OF THE INVENTION

The present invention relates to articles of bulk-solidifying amorphous alloys with improved durability and fatigue life, and to methods of improving durability and fatigue life of bulk-solidifying amorphous alloys.

BACKGROUND OF THE INVENTION

Amorphous alloys (or metallic glasses) have no discernable pattern existing in their atomic structure in contrast to ordinary crystalline metals and alloys. This unique atomic structure results in very high yield strengths and high hardnesses for amorphous alloys. These superior properties are generally attributed to the lack of the dislocations typically found in crystalline atomic structures. In addition, amorphous alloys generally have high elastic strain limits approaching, up to 2.0%, much higher than any other metallic alloys. For example, the yield strength of Ti-base amorphous alloys is about 2 GPa or more, values exceeding the current state of crystalline titanium alloys. Finally, amorphous alloys can be formed by a variety of methods among which quenching from the liquid state is the most common and widely used method.

However, amorphous alloys in bulk forms (alloys capable of being formed with a minimum dimension of at least 0.5 mm, which are also referred to as bulk-solidifying amorphous alloys or bulk amorphous alloys) have some shortcomings which result in reduced utilization of the high yield strength and high elastic strain limit properties of these materials in load bearing structural applications. First, the sensitivity of amorphous alloys to defects and their low resistance to crack propagation from defects are primary causes of premature failure. For example, the fatigue endurance limit of amorphous alloys can be quite low, and values as low as 10% of its ultimate strength have been reported. In the case of high stress-low cycle cases, amorphous alloys generally fail around 50% of their ultimate strength after several thousands cycles. This is generally attributed to the "micro-structureless" nature of the amorphous phase and the lack of any of the work-hardening mechanisms typically found in crystalline alloys.

Accordingly, the conventional work hardening and strengthening methods generally used for crystalline alloys have been deemed to be non-applicable to amorphous alloys. Therefore, some composite forms of amorphous alloys have been developed to remedy the shortcomings of toughness and fatigue resistance. Although these composites show improvement in the toughness and durability (or fatigue resistance) it can only be done at the expense of the high yield strengths and the high elastic strain limits of the pure amorphous alloy materials, and as such defeat the principal benefits of using these materials. Accordingly, there is a need for amorphous alloys with improved durability and fatigue resistance that are capable of maintaining relatively high yield strengths and high elastic limits in loading bearing structural applications.

SUMMARY OF THE INVENTION

The current invention is directed to articles of bulk-solidifying amorphous alloys with improved durability and fatigue life, and more specifically to articles of bulk-solidifying amorphous alloys subjected to a surface treatment utilizing a shot-peening process.

The invention also relates to methods of improving the durability and fatigue life of bulk-solidifying amorphous alloys utilizing a shot-peening process.

In one embodiment of the invention, the shot-peening process is applied to cover a substantial portion of the surface of an amorphous alloy article.

In another embodiment of the invention, the shot-peening process is applied to at least the portion of the surface of the amorphous alloy article with the maximum tensile stresses.

In still another embodiment, the invention is an article of amorphous alloy where at least a portion of the surface is subjected to a shot-peening process.

In yet another embodiment, the invention is an article of an in-situ amorphous alloy composite and at least a portion of the surface of the article is subjected to a shot-peening process.

In still yet another embodiment, the invention is a golf club face insert made of an amorphous alloy or an in-situ amorphous alloy composite, and the back surface of the insert is treated with a shot-peening process.

DETAILED DESCRIPTION OF THE INVENTION

The current invention is directed to articles of bulk-solidifying amorphous alloys with improved toughness, durability and fatigue life, and more specifically to articles of bulk-solidifying amorphous alloys subjected to a surface treatment utilizing a shot-peening process. The invention is also directed to methods of improving the toughness, durability and fatigue life of bulk-solidifying amorphous alloys utilizing a shot-peening process.

Shot-peening is a means of cold working the surface of metal parts by means of a hail or blast of round metal shot directed against the surface. Although other metal shots can be used, round shots made of heat-treated steel are generally satisfactory for use. The hardness of the metal shot is generally in the range of from 45 Rc to 60 Rc, or more. The diameter of the round shot size is generally in the range of 0.003" to 0.20" or more. Preferably the metal shot size is in the range of 0.006" to 0.040".

The inventors have found surprisingly that the toughness and durability of bulk amorphous alloys can be dramatically improved by shot-peening the surface, a process which is generally reserved for metals, which exhibit both work hardening and with ductility. Surprisingly, the shot-peening process can be used to alleviate the effects of various defects on the amorphous alloys despite the limited ductility of amorphous alloys and the difficulty of cold-forming these materials.

Although any suitable amorphous alloy may be used with the current invention, a particularly preferred set of amorphous alloys are "bulk solidifying amorphous alloys". Bulk solidifying amorphous alloys are recently discovered family of amorphous alloys, which can be cooled at cooling rates of about 1,000 K/sec or less, substantially lower than traditional amorphous alloys, and retain their amorphous atomic structure. As such, these bulk solidifying amorphous alloys can be produced in thicknesses of about 0.5 mm or more, substantially thicker than conventional amorphous alloys which have maximum thicknesses of about 0.020 mm, and which require cooling rates of $10^5$ K/sec or more. U.S. Pat. Nos. 5,288,344; 5,368,659; 5,618,359; and 5,735,975, the disclosures of which are incorporated by reference in their entirety, disclose such bulk solidifying amorphous alloys.

One exemplary family of bulk solidifying amorphous alloys can be described as $(ZrTi)_a(Ni,Cu,Fe)_b(Be,Al,Si,B)_c$, where a is in the range of from 40 to 75, b is in the range of from 5 to 60, and c in the range of from 0 to 40 in atomic percentages. Furthermore, these alloys can accommodate substantial amounts of other transition metals up to 20% atomic percentage, and more, including preferably metals such as Nb, Ta, V, and Co.

A preferable alloy family is $(Zr,Ti)_a(Ni,Cu)_b(Be)_c$, where a is in the range of from 40 to 75, b is in the range of from 5 to 50, and c in the range of from 5 to 40 in atomic percentages. Another preferable alloy family is $(Zr)_a(Nb,Ti)_b(Ni,Cu)_c(Al)_d$, where a is in the range of from 45 to 65, b is in the range of from 0 to 10, c is in the range of from 20 to 40, and d in the range of from 7.5 to 15 in atomic percentages. In these alloys, Zr can be substantially substituted by Hf and other elements such as Cr, V, Ta, Mo, and W can also be added in limited amounts.

Another set of bulk-solidifying amorphous alloys are based on ferrous metals (Fe, Ni, Co). Examples of such compositions are disclosed in U.S. Pat. No. 6,325,868, and in publications to (A. Inoue et. al., Appl. Phys. Lett., Volume 71, p 464 (1997)), (Shen et. al., Mater. Trans., JIM, Volume 42, p 2136 (2001)), and Japanese patent application 2000126277 (Publ. # 2001303218 A), the disclosures of which are incorporated herein by reference. One exemplary composition of such alloys is Fe72Al7Zr10Mo5W2B15. Although, these alloy compositions are not as processable as the Zr-base alloy systems, they can be still be processed in thicknesses of around 1.0 mm or more, sufficient enough to be utilized in the current invention. In these alloys, high atomic number elements as Ta, Nb, Mo, Zr, and W can also be used as alloying additions to increase radiation shielding effectiveness.

In general, crystalline precipitates in bulk amorphous alloys can be highly detrimental to their properties, especially to the toughness and strength of these materials, and as such it is generally preferred to minimize the volume fraction of these precipitates if possible. However, there are cases in which ductile crystalline phases precipitate in-situ during the processing of bulk amorphous alloys, which can be indeed beneficial to the properties of bulk amorphous alloys, and especially to the toughness and ductility of these materials. Such bulk amorphous alloys comprising such beneficial precipitates are also included in the current invention. One exemplary case is disclosed in (C. C. Hays et. al, Physical Review Letters, Vol. 84, p 2901, 2000), the disclosure of which is incorporated herein by reference.

In one embodiment, the shot-peening is applied to at least a portion of an amorphous alloy article. In another embodiment, the shot-peening is applied to cover a substantial portion of the surface of the amorphous alloy article. In one preferred embodient, the shot-peening is applied to cover substantially the entire surface of the article, which is subjected to tensile stresses in service. For example, in the case of a rotating round beam, such as a transmission shaft, where the surface is subjected to maximum tensile stresses even momentarily, the shot-peening is applied to the whole circumferential surface of the rotating round beam. In another embodiment, the shot-peening is applied to at least a portion of the surface of an amorphous alloy article with the maximum tensile stresses. For example, in the case of an article subject to bending in one direction, the shot-peening is applied to the surface on the opposite side of the loading (e.g. to the backside of a face of a golf club). In one embodiment, the article is a golf club face insert made of amorphous alloy or an in-situ amorphous alloy composite, and the back surface of the insert is treated with shot-peening process.

The following examples illustrate representative applications of the current invention, but do not limit the scope of how the current invention can be beneficially used in other applications:

EXAMPLE 1

Three samples of an untreated golf club face insert made of a bulk-solidifying amorphous alloy (VIT-001 trade designation Zr (41.2) Ti(13.8) Cu (12.5) Ni(10) Be (22.5) atomic percent) were loaded to a failure with loading applied on the front hitting surface. The samples failed with peak loads varying from 2,300 lbs to 2,700 lbs. The back side of similar samples from the same lot were subjected to a shot-peening process with nominal Almen Intensity (a standard measuring procedure to calibrate the intensity of shot-peening process) of 0.0085 A and shot size of S230R (0.023" shot diameter). The samples were then subjected to the same loading conditions and failed with peak loads of over 3,300 lbs.

EXAMPLE 2

The untreated golf club face insert samples of Example 1 were subjected to a fatigue cycling loading (similar to in example 1) with a peak load of 2,100 lbs and a minimum load of 1/10 of peak load. The samples failed after several hundreds cycles (between approximately 200 cycles to 900 cycles). The back side of similar samples from the same lot were subjected to a shot-peening process with nominal Almen intensity of 0.0085 A and shot size of S230R (0.023" shot diameter). The samples were then subjected to the same fatigue cycling loading conditions, and survived more than 3,000 cycles.

EXAMPLE 3

The back side of untreated golf club face insert samples of Example 1 were subjected to a shot-peening process with nominal Almen intensity of 0.0060 A and shot size of S230R (0.023" shot diameter). The samples were then subjected to the same fatigue cycling and a peak load of 2,400 lbs. The treated samples survived more than 3,000 cycles.

EXAMPLE 4

The back side of untreated golf club face insert samples of Example 1 were subjected to a shot-peening process with nominal Almen intensity of 0.011 A and shot size of S330R (0.033" shot diameter). The samples were then subjected to the same fatigue cycling and a peak load of 2,700 lbs. The treated samples survived more than 1,400 cycles.

EXAMPLE 5

Three samples of untreated golf club face inserts made of a bulk-solidifying amorphous alloy in-situ composite with dendritic beta phase (LM-2 trade designation Zr (56.2) Ti(11.2) Nb (7.5) Cu (6.9) Ni(5.5) Be (12.5) atomic percent) were subjected to a fatigue cycling with a peak load of 2,400 lbs applied on the front hitting surface. The samples failed after several hundreds cycles (between approximately 200 cycles to 500 cycles). The back side of similar samples from the same lot were subjected to a shot-peening process with nominal Almen intensity of 0.006 A and shot size of S230R (0.023" shot diameter). The samples were then subjected to the same fatigue cycling and loading conditions, and survived more than 1,500 cycles. Another set of similar samples were subjected to a shot-peening process with nominal Almen intensity of 0.006 A and shot size of S330R (0.033" shot diameter). The samples were then subjected to the same fatigue cycling and loading conditions, and survived more than 3,000 cycles.

In addition to the specific features and embodiments described above, it is understood that the present invention includes all equivalents to the structures and features described herein, and is not to be limited to the disclosed embodiments. For example, the effects of shot-peening on the surface of the amorphous alloys can be achieved through other suitable, alternative means such as laser shock peening, wherein the stress is introduced by a shock wave generated by instantaneous ablation of a small amount of material on the surface when a high intensity laser beam illuminates the surface. The same flexibility for practicing the invention is true with respect to the particular amorphous alloy selected. Accordingly, individuals skilled in the art to which the present articles and methods pertain will understand that variations and modifications to the embodiments described can be used beneficially without departing from the scope of the invention.

What is claimed is:

1. An article comprising:

an exterior surface consisting of a bulk-solidifying amorphous alloy having a yield strength of at least 2 GPa, the exterior surface including a loading surface and a back surface on an opposite side of the loading surface;

the loading surface subject to a bending force toward the back surface, the back surface thereby subject to tensile stress;

the back surface including a surface treatment comprising a shot peening process; and the loading surface not including the surface treatment;

wherein the back surface has an enhanced durability as compared to the loading surface and wherein the treated article is a golf ball face insert.

2. The article of claim 1, wherein the bulk-solidifying amorphous alloy has a glass transition temperature of 500° C. or above.

3. The article of claim 2, wherein the bulk-solidifying amorphous alloy comprises a composition being represented by a following general formula:

$$Ni_a(Zr_{1-x}Ti_x)_bSi_c$$

where a, b and c are atomic percentages of nickel, zirconium plus titanium, and silicon, respectively, and x is an atomic fraction of titanium to zirconium, wherein;

45 atomic %≤a≤63 atomic %, 32 atomic %≤b≤48 atomic %, 1 atomic %≤c≤11 atomic %, and 0.4≤x≤0.6.

4. The article of claim 3, wherein the bulk-solidifying amorphous alloy further comprises V, Cr, Mn, Cu, Co, W, Sn, Mo, Y, C, B, P, Al, or combinations thereof.

5. The article of claim 2, wherein the bulk-solidifying amorphous alloy comprises a composition being represented by a following general formula:

$$Ni_d(Zr_{1-y}Ti_x)_eP_f$$

where d, e and f are atomic percentages of nickel, zirconium plus titanium, and phosphorus, respectively, and y is an atomic fraction of titanium to zirconium, wherein;

50 atomic %≤d≤62 atomic %, 33 atomic %≤e≤46 atomic %, 3 atomic %≤f≤8 atomic %, and 0.4≤y ≤0.6.

6. The article of claim 1, wherein the bulk-solidifying amorphous alloy comprises a ferrous alloy.

7. The article of claim 6, wherein the bulk-solidifying amorphous alloy is the ferrous alloy comprising Fe, Ni and Co.

8. The article of claim 1, wherein the bulk-solidifying amorphous alloy comprises a Ni-containing alloy.

9. The article of claim 1, wherein the bulk-solidifying amorphous alloy has a glass transition temperature of 550° C. or above.

10. A method of improving durability and fatigue resistance of an exterior surface treated article of bulk-solidifying amorphous alloy having a yield strength of at least 2 GPa, the exterior surface including a loading surface and a back surface on an opposite side of the loading surface, the loading surface subject to a bending force toward the back surface, the back surface thereby subject to tensile stress, the method comprising:

creating a plurality of deformations solely in the back surface of the article by mechanically compressing a plurality of shots against the back surface; and the loading surface comprising a surface free of the plurality of deformations; wherein the back surface is subject to maximum tensile stresses with a bending force applied to the loading surface and wherein the treated article is a golf ball face insert.

* * * * *